United States Patent [19]

Chow et al.

[11] Patent Number: 5,007,588

[45] Date of Patent: Apr. 16, 1991

[54] ASPIRATION-TYPE SPRAYER

[75] Inventors: Ho Chow, Cliffside Park; Joseph E. Testa, Woodcliff Lake, both of N.J.

[73] Assignee: Hunter-Melnor, Inc., Memphis, Tenn.

[21] Appl. No.: 281,559

[22] Filed: Dec. 8, 1988

[51] Int. Cl.[5] ..... B05B 7/04

[52] U.S. Cl. ..... 239/318; 239/310; 222/637

[58] Field of Search ..... 239/310, 316, 318, 340, 239/341, 354, 428.5, 390, 394, 581.1, 600, 391, 509; 251/300, 297, 301; 222/630, 637

[56] References Cited

U.S. PATENT DOCUMENTS

| | | | |
|---|---|---|---|
| 1,003,688 | 9/1911 | Barnes | 239/353 |
| 1,333,217 | 3/1920 | Perry | 251/300 |
| 1,480,141 | 1/1924 | Artese | 251/300 |
| 2,316,781 | 4/1943 | Fox | 239/310 |
| 2,838,213 | 6/1958 | Kinley | 222/498 |
| 2,841,442 | 7/1958 | Skipwith, Jr. | 239/340 |
| 2,991,939 | 7/1961 | Packard | 239/340 |
| 3,062,453 | 11/1962 | Matthews | 239/341 |
| 3,099,394 | 7/1963 | Lynn | 239/310 |
| 3,204,875 | 9/1965 | Langstroth | 239/310 |
| 3,521,665 | 7/1970 | Poulsen | 251/300 |
| 3,940,069 | 2/1976 | Gunzel, Jr. et al. | 239/318 |
| 4,349,157 | 9/1982 | Beiswenger et al. | 239/318 |
| 4,475,689 | 10/1984 | Hauger et al. | 239/318 |
| 4,736,891 | 4/1988 | Chow et al. | 239/318 |
| 4,750,674 | 6/1988 | Chow et al. | 239/318 |

*Primary Examiner*—Andres Kashnikow
*Assistant Examiner*—Christopher G. Trainor
*Attorney, Agent, or Firm*—James & Franklin

[57] ABSTRACT

An aspiration sprayer comprises a head which is preferably permanently attached to a container in which additive material is received. The head may or may not be movable between positions controlling the degree of aspiration affected, and is provided with a cap movable between a first position in which the cap seals the container and prevents the additive material from escaping therefrom and a second position in which the container is unsealed and aspiration of the contents thereof can take place. Elements may be provided as part of the sprayer assembly for controlling the flow of the aspirating fluid. The cap is secured in its sealing position by an element which requires special manipulation for release, thereby providing an important safety feature.

20 Claims, 8 Drawing Sheets

FIG. 8
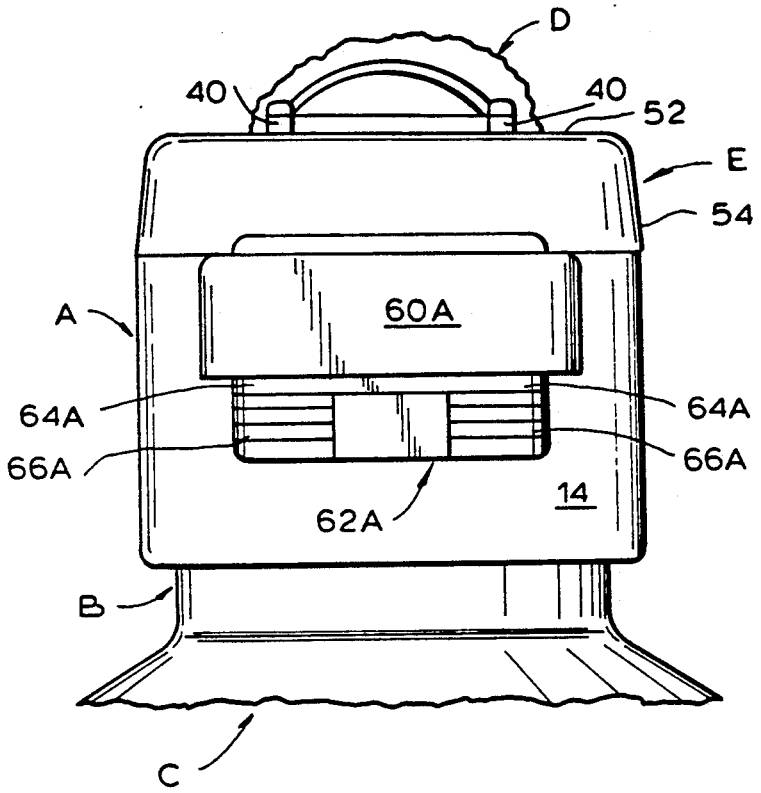
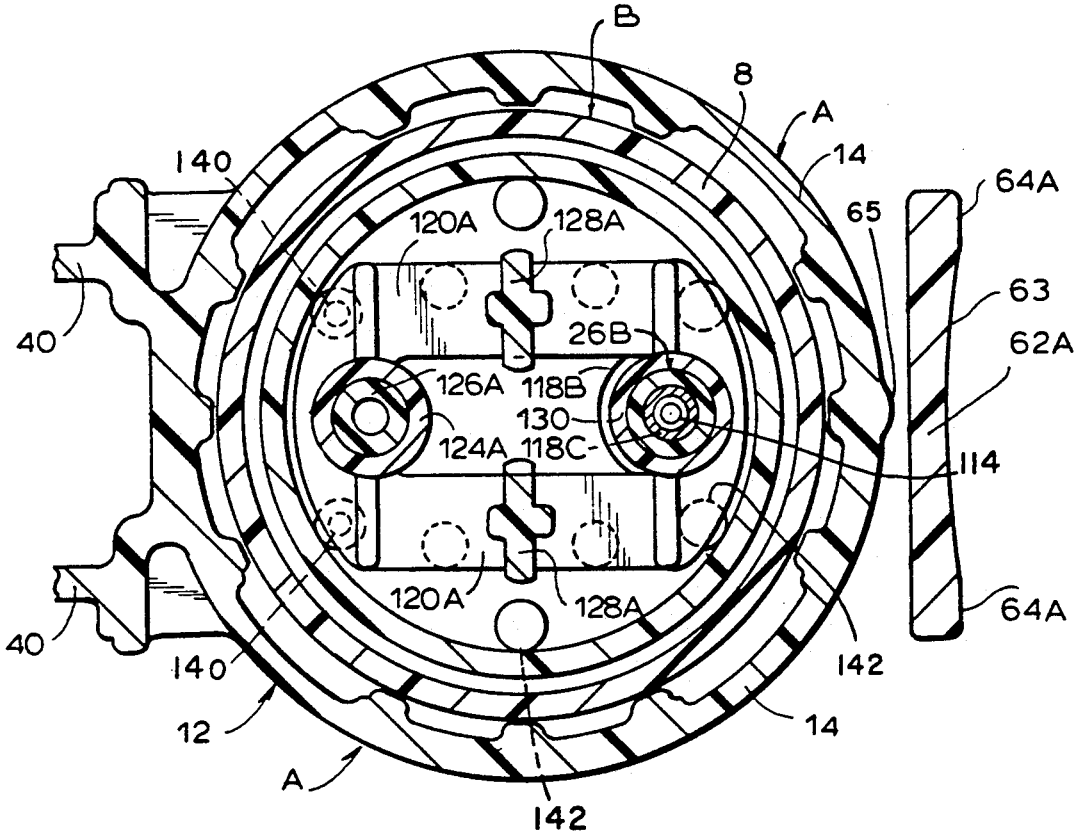
FIG. 19

FIG. 13
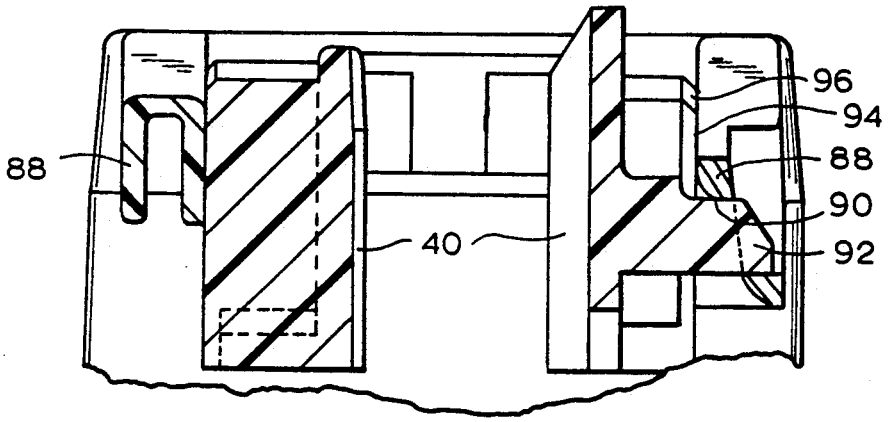
FIG. 16
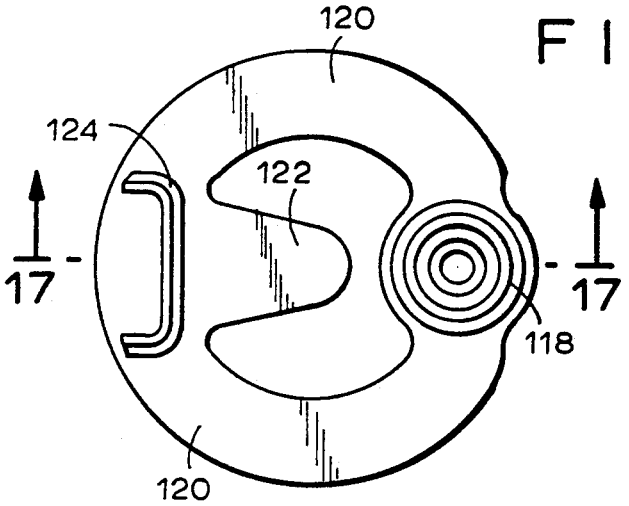
FIG. 15
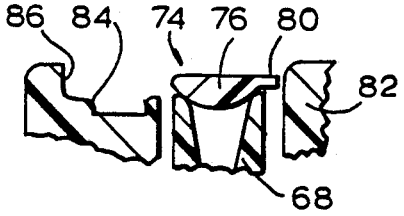
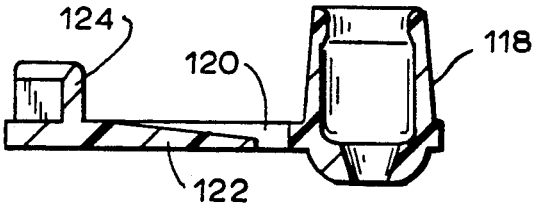
FIG. 17

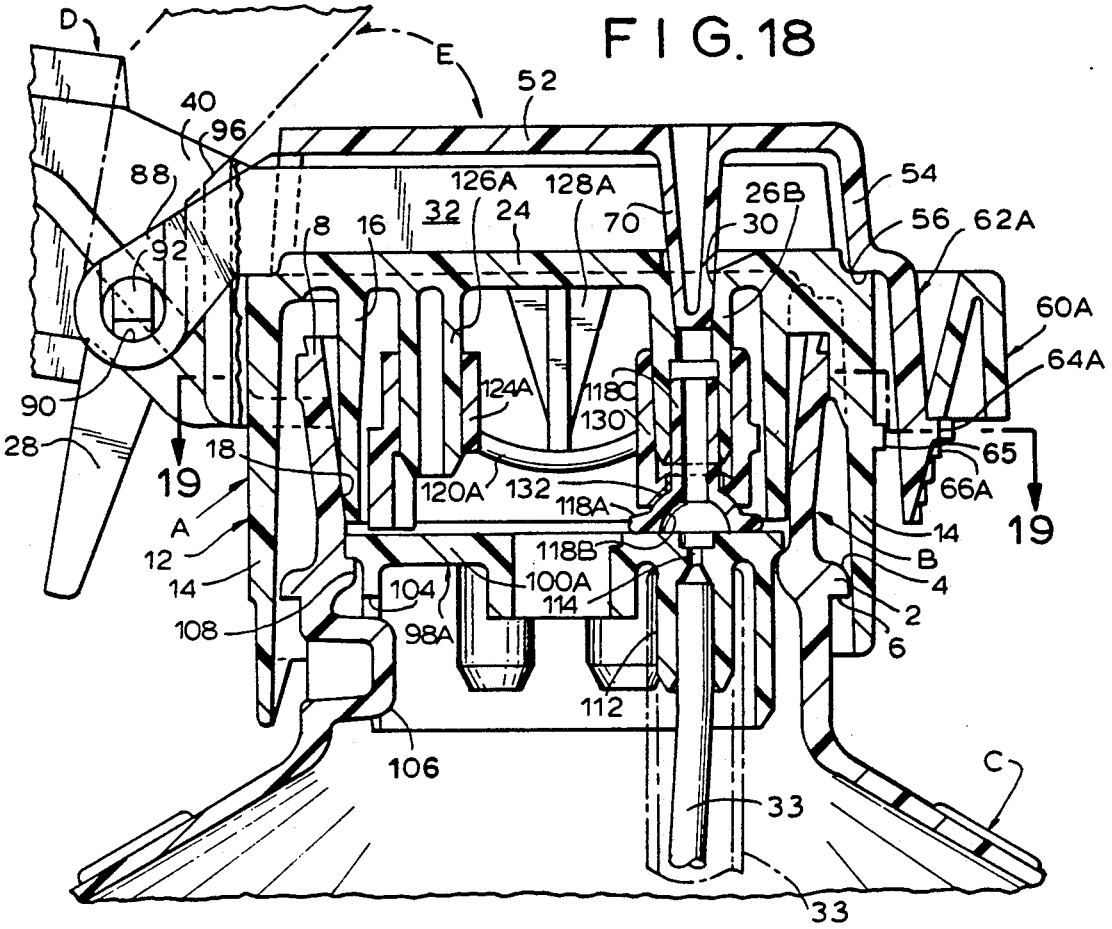
FIG. 18
FIG. 20
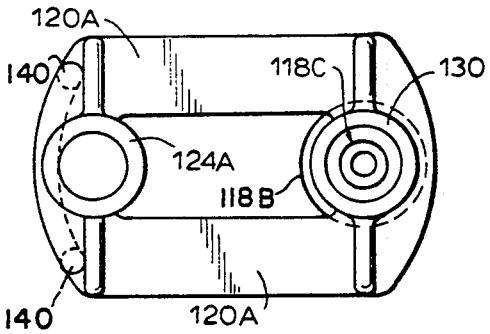
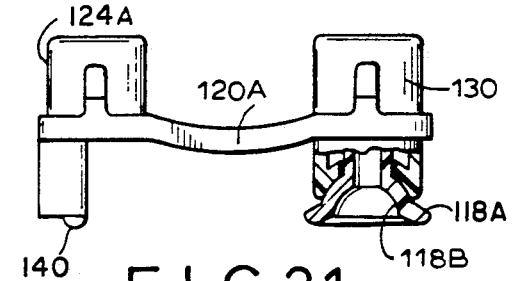
FIG. 21
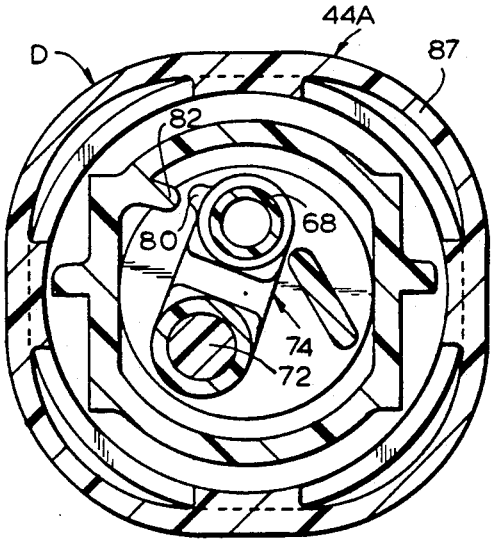
FIG. 14

ASPIRATION-TYPE SPRAYER

The present invention relates to the construction of an aspiration-type sprayer which facilitates assembly, reduces cost, and in particular provides effective control of the aspiration while at the same time ensuring, when aspiration does not take place, that the chemical to be sprayed is sealed within the container and thus does not present a source of danger.

Aspiration-type sprayers are commonly used to mix relatively small quantities of an additive material with relatively large quantities of a carrier fluid such as water, the mixing being effected by causing the carrier fluid to pass rapidly over an opening which communicates with the interior of a container carrying the additive material and produce a suction effect which sucks the additive material into the stream of carrier fluid. This type of sprayer is frequently used in an agricultural environment, to apply chemicals of various types (e.g. pesticides) to bushes and trees. The present invention will be here disclosed as specially designed for such a use, with the additive material generally referred to as an insecticide, but it will be appreciated that it is not limited to such applications, and that the additive material need not be an insecticide.

Quite frequently, particularly in agricultural applications, the additive substance to be sprayed is dangerous to humans, certainly if taken internally and frequently if applied externally. Many insecticides, commonly sprayed by homeowners, are of that character, and hence these substances are necessarily stored in household environments where they are exposed to children and thus constitute a very serious potential hazard.

Aspirating sprayers of the type under discussion have in the past been so constructed as to be attachable to and detachable from the containers for the insecticide or other material to be applied, so that when one container of insecticide has been emptied the sprayer can be removed and attached to another container. This is economically advantageous, but it also means that the containers of insecticide are of the openable type both before and after the sprayer has been put in place thereon. Thus the containers themselves, while on the household shelf waiting to be used, are hazardous, since a child may gain access thereto, remove the cap or sprayer, as the case may be, and thus be exposed to the insecticide.

In our prior Pat. No. 4,750,674 of June 14, 1988 entitled "Aspiration-Type Sprayer", assigned to the assignee of this application, a sprayer is disclosed which is permanently attached to the container for insecticide or the like, and is so associated therewith that it effectively seals the contents of the container, preventing spilling thereof or other access thereto by children or careless handlers, while at the same time enabling effective aspiration-type spraying to take place when desired. (An improvement thereon is disclosed in our pending application Ser. No. 154,311, filed Feb. 10, 1988 and entitled "Aspiration-Type Sprayer With Improved Safety Feature".) Since the sprayer and the container form a permanent combination the sprayer cannot be reused once the contents of the container have been exhausted—the container and the attached sprayer are simply discarded together. From a practical point of view this means that the sprayer must be sufficiently inexpensive to manufacture and assemble so that its permanent association with the container will be economically feasible. In that embodiment the sprayer is mounted on the container so as to be rotatable about the container neck between a position which seals the container and one or more positions where aspiration of the container contents can take place. That arrangement, although eminently satisfactory and commercially acceptable, is relatively complex and therefore somewhat costly to manufacture. These factors have not significantly affected the commercial success of structures corresponding to the disclosure of that patent, but there is a demand for structures having the sealing-aspiration characteristics of the previous structures but which are simpler, less expensive, made of fewer parts, and sturdier.

In the structure of the previous patent the sealing of the container, when the aspiration assembly is appropriately positioned, is accomplished by means of sealing cups which are carried by that portion of the assembly which is rotatable relative to the container. Those cups perform their sealing function (and the function of selecting the desired degree of aspiration that should take place) quite satisfactorily, but in some instances it may be desired to effect a more positive seal of the container, thereby to provide an enhanced safety factor.

The aspiration assembly of the prior patent included means for controlling the flow of aspirating liquid which is relatively rudimentary in structure and which requires rotation in order to effect the desired control. Users of devices of this type prefer a lever-type control, and hence in some embodiments of the present invention a novel lever-type control of simple and inexpensive but reliable construction has been included.

The two basic requirements—efficient and reliable sealing and aspiration and ready selection between them on the one hand and low cost on the other hand—so effectively achieved in the construction of our prior patent even though they would appear to be antithetical, have also been achieved in the constructions here disclosed, but with increased structural simplicity and lower cost.

In one type of prior art aspiration assembly quite widely used the aspiration passage through which the contents of the container pass to the point where they are aspirated communicates with an air bleed passage exposed at the outside of the assembly. When that air bleed passage remains exposed no aspiration takes place even though aspirating fluid flows over the aspiration opening because no suction is exerted on the container contents. It is only when that air bleed passage is manually closed, as by the user of the device placing his finger over it, that aspiration occurs. This constitutes a simple and inexpensive means of controlling when aspiration occurs and when it does not, and is therefore widely accepted because of its low cost. However, since the air bleed passage communicates with the interior of the container, as it must if it is to perform its desired function, it also represents a pathway through which the contents of the container can escape if the container is mishandled. To eliminate this problem, and to do so in a positive but inexpensive and uncomplicated fashion, that part carried by the cap of the instant assembly which seals the aspiration opening when the cap is in its operative position does so by entering that opening and penetrating it at least to the depth where the air bleed opening communicates with it so as to simultaneously seal the latter.

The aspiration assembly also includes, as is conventional, an air vent passage between the atmosphere and the upper portion of the container so that aspiration-preventing pressure reduction does not occur in the container as aspiration takes place. The cap of the aspiration assembly of the present invention has a part which, when the cap is in its operative position, engages and seals that air vent passage so that container contents cannot escape therefrom when the cap is in its operative position.

Embodiments of the present invention are here disclosed where the aspiration assembly is rotatable about the neck of the container in order to select different degrees of aspiration (but not, as in the embodiment of our earlier patent, to effect sealing), and a sealing adapter, such as a cup, is moved into fluid communication with an aspiration opening of desired size. The mounting and actuation of that adapter, as here disclosed, is improved with respect to the mounting of the sealing cups of the embodiment of our earlier patent to facilitate assembly, enhance sturdiness, reduce the number of parts required, and achieve more positive and reliable operation.

As with the embodiment of our prior patent, the embodiments here disclosed embody the safety feature that movement of the cap from its operative or sealing position is strongly resisted by means requiring a relatively sophisticated and non-obvious type of manipulation to enable such movement, thus effectively rendering the sprayer child-proof from a safety point of view.

To the accomplishment of the above, and to such other objects as may hereinafter appear, the present invention relates to the construction of an aspiration-type sprayer preferably designed to be permanently attached to a container for the additive substance to be sprayed, as defined in the appended claims and as described in this specification, taken together with the accompany drawings in which FIG. 1 is a side elevational view, partially broken away in cross-section, of a first embodiment of the present invention in place on the neck of a container, the sealing cover being shown in its operative sealing position;

FIG. 8 is an end elevational view of the embodiment of FIG. 6 taken from the right-hand side thereof;

FIG. 13 is a cross-sectional view of the pivotal mounting structure for the cap of the embodiment of FIG. 6;

FIG. 14 is a cross-sectional view taken along the line 14—14 of FIG. 12;

FIG. 15 is a detail cross-sectional view taken along the line 15—15 of FIG. 11 illustrating the detent and stop action of the flow-controlling valve;

FIG. 16 is a top plan view of the cup carrier of FIG. 6;

FIG. 17 is a cross-sectional view taken along the line 17—17 of FIG. 16;

FIG. 18 is a cross-sectional view of a third embodiment of the present invention;

FIG. 19 is a cross-sectional view taken along the line 19—19 of FIG. 18;

FIG. 20 is a top plan view of the cup carrier of FIG. 18; and

FIG. 21 is a side elevational view, partially broken away in cross-section, of that cup carrier with the cup in place.

Figure 1:
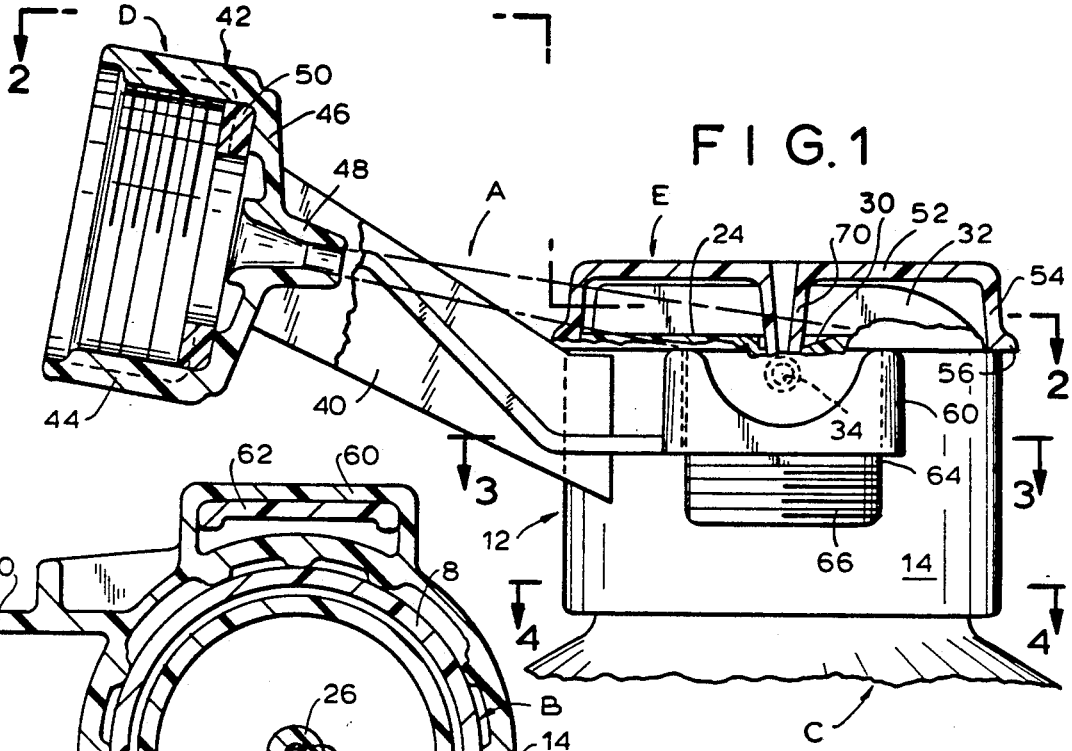
Figure 3:
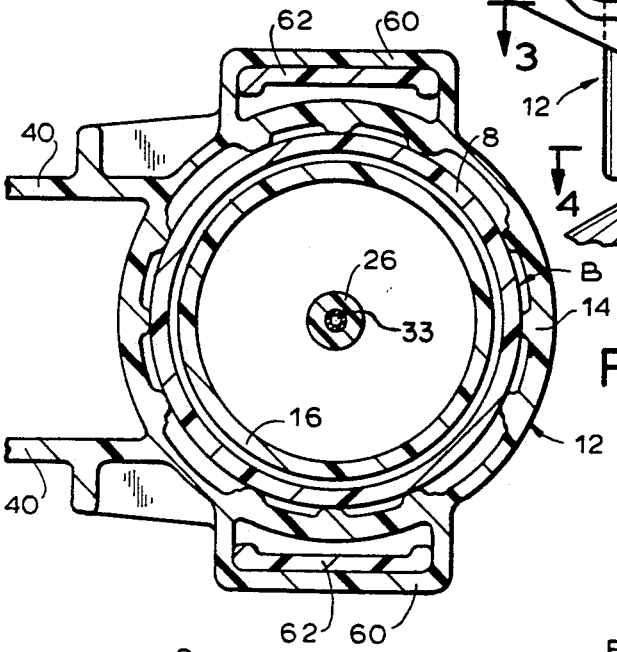
FIG. 3 is a cross-sectional view taken along the line 3—3 of FIG. 1.

The sprayer, generally designated A, is designed to be mounted, preferably permanently, on the neck B of a container C for the material to be sprayed, such as an insecticide. The carrier fluid, in the embodiments here disclosed, is a stream of water coming from, for example, a garden hose (not shown) adapted to be secured to the sprayer by a coupling nut generally designated D.

The container C is here disclosed in the form of a jar or bottle, the neck B of which has an outwardly extending circumferential ridge 2 having a downwardly and outwardly inclined upper surface 4 and a lower surface 6 defining a downwardly facing ledge.

The embodiment of FIGS. 1-5 is the simplest embodiment here disclosed, designed to provide for only a single degree of aspiration. The sprayer A of that embodiment includes a body generally designated 12 having a depending outer cylindrical side wall 14 and an inner depending cylindrical wall 16 between which the upper extremity 8 of the container neck B is designed to be received. The inner wall 16 is snugly received inside the container neck portion 8 so as to engage that neck portion and form a seal at 18 completely therearound. The wall 14 is provided on its inner surface with a plurality of circumferentially spaced inwardly extending lugs 20 having radially inwardly and upwardly extending surfaces terminating in axially upwardly facing ledges 22. The wall 14 is sized so as to fit closely over the circumferential ridge 2 of the container, and when forced down to its position shown in the drawings the camming interengagement between the lugs 20 on the inside of the wall 14 and the ridge 2 on the outside of the bottle neck causes the bottle neck to contract slightly inwardly and the head wall 14 to expand slightly outwardly especially at areas without lugs 20, until the lugs 20 snap beneath the ridge 2, after which the head 14 is permanently secured to the bottle.

That head 12 further comprises a top wall 24 provided with a centrally located depending portion 26 centrally apertured to define a passageway 27 from its lower end 28 to its upper end 30 exposed at the top wall 24 and located between upwardly extending flanges 32. An aspiration tube 33 is designed to be secured to the portion 26 either inside it, as shown in solid lines, or outside it, as shown in broken lines, and to extend down into the body of the container C. Thus the upper end 30 of the passageway defines the aspiration opening over which aspirating fluid is designed to pass. Communicating laterally with the upper portion of the passage, and extending from that passage to the side of the head 12, is an air bleed passage 34. As may best be seen from FIG. 5, the air bleed passage 34 communicates with the passage 27 at a point below the upper end 30 of the passage 27. The horizontal wall 24 of the head 12 is also provided with a depression 36 the lower end of which has opening 38 defining an air vent passage for the interior of the container C.

Figure 2:
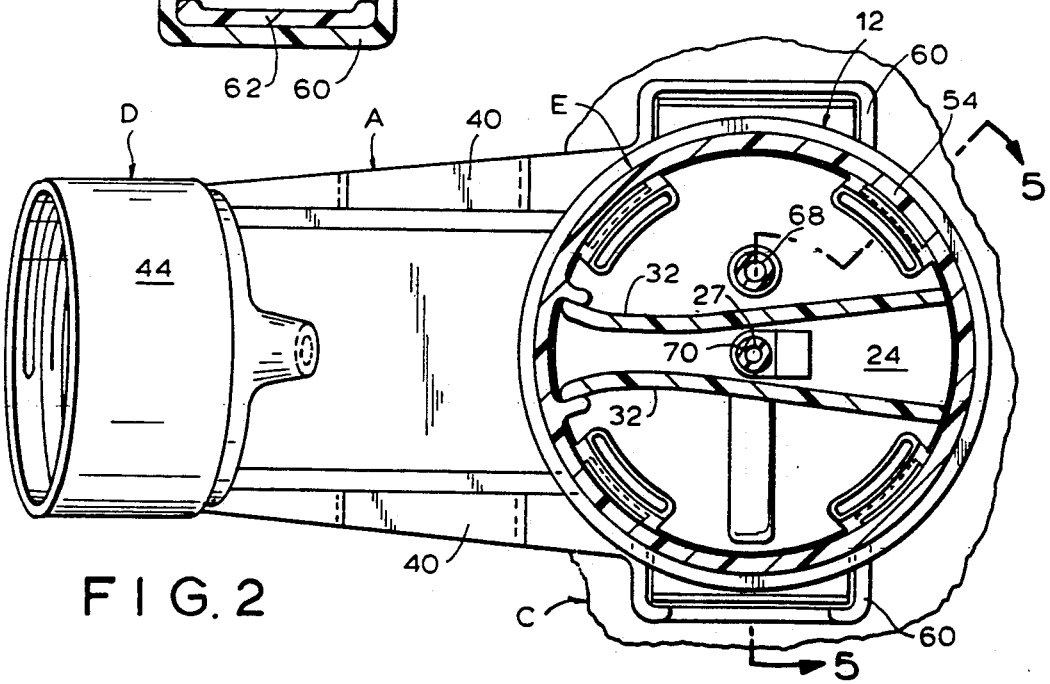
FIG. 2 is a cross-sectional view taken along the line 2—2 of FIG. 1.
Figure 4:
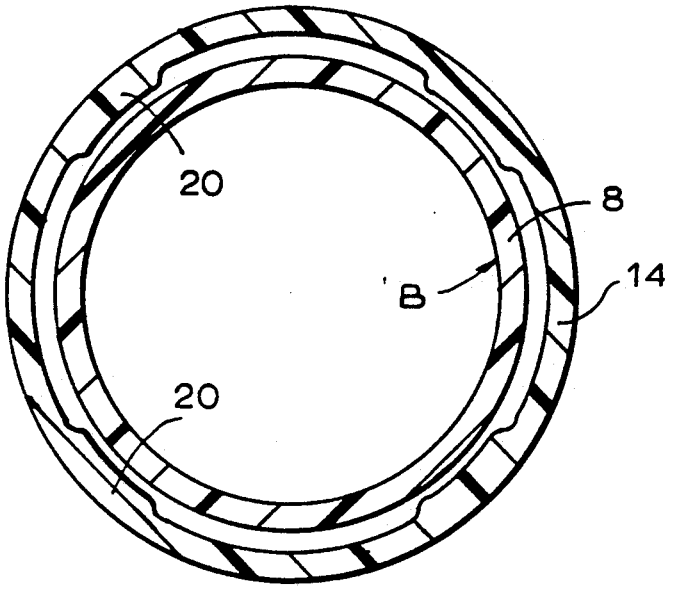
FIG. 4 is a cross-sectional view taken along the line 4—4 of FIG. 1.

Extending laterally and somewhat upwardly from the head 12, as may best be seen from FIGS. 1 and 2, are a pair of spaced arms 40 carrying at their ends a nozzle combined with the coupling nut D. It is defined by a cylindrical internally threaded wall 44 into which a hose end is adapted to be screwed and an end wall 46 terminating in a central nozzle 48 oriented downwardly so that a stream of water emanating from the nozzle 48 will pass between the flanges 32 and will flow over the wall 24 and the upper end 30 of the passage 27 defining the aspiration opening of the structure. As is common, a sealing washer 50 may be received on the wall 46 inside the wall 44.

As will be apparent, when a hose is connected to the device and water flows therethrough, that water will pass through the nozzle 48, be directed by the nozzle to flow over the aspiration opening 30, and, if the air bleed passage 34 is closed, as by the operator putting his finger thereover, the contents of the container will, by the aspiration effect, be sucked up through the dip tube 33 and the passage 27, with the atmospheric pressure entering the top of the container C through the air vent passage 38. If, however, the air bleed passage 34 is exposed, any suction exerted by the water flowing over the aspiration opening 30 will be neutralized by pressure entering the air bleed passage 34, and hence the contents of the container will not be sucked up.

Figure 5:
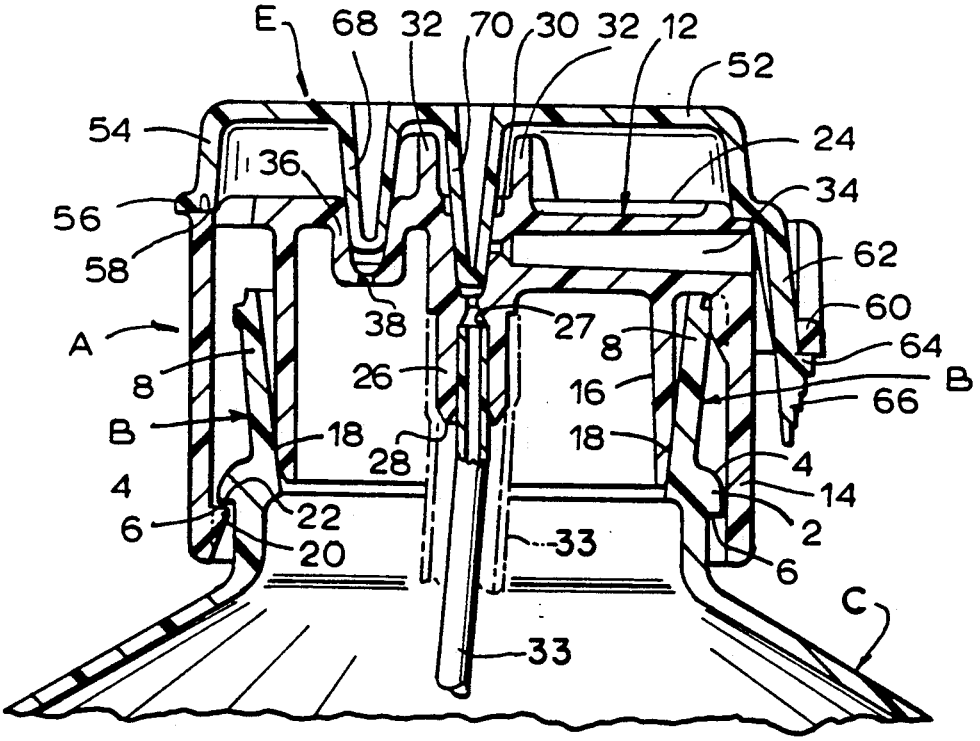
FIG. 5 is a cross-sectional view taken along the line 5—5 of FIG. 2.
Figure 6:
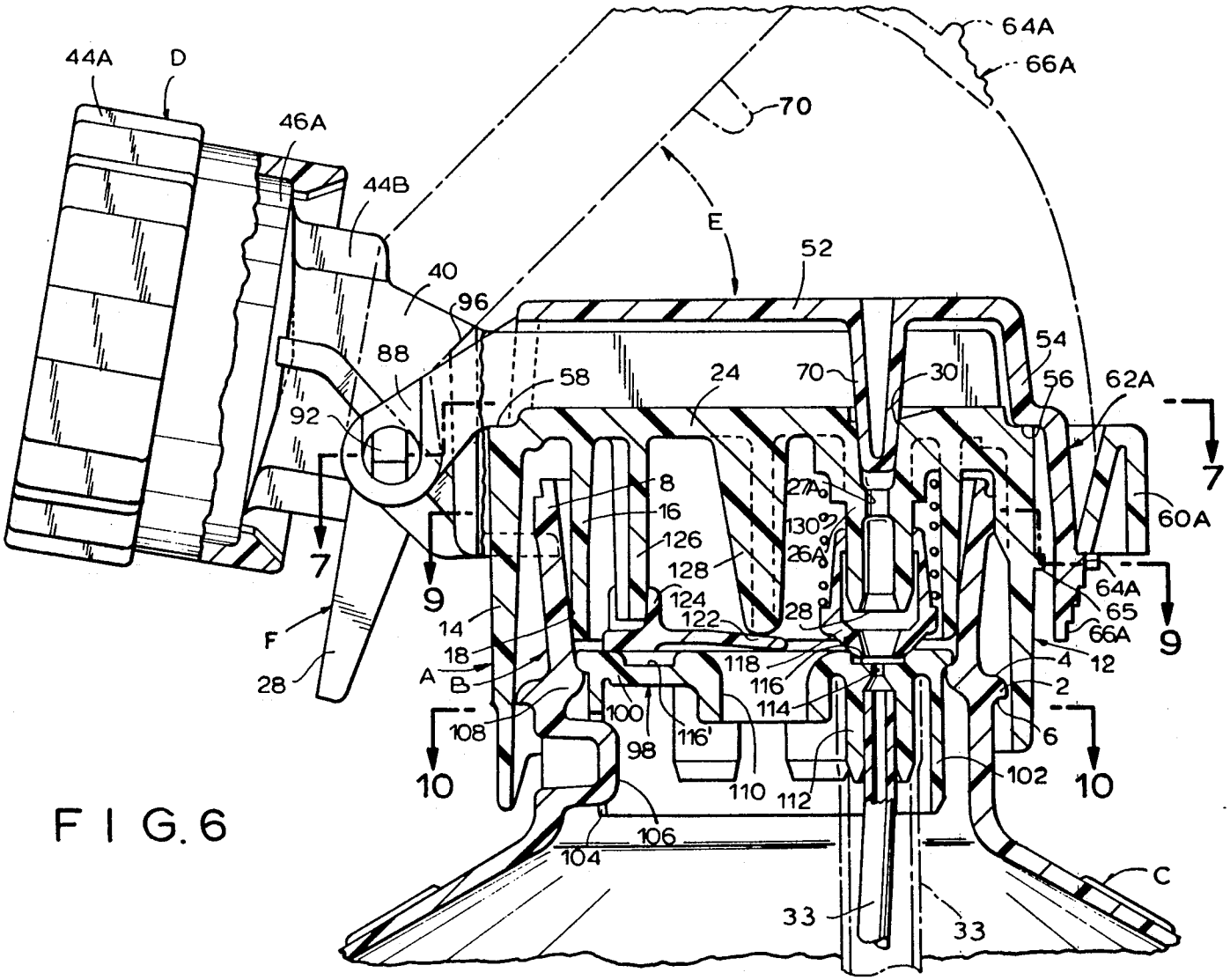
FIG. 6 is a diametral cross-sectional view of a second embodiment of the present invention showing the aspiration assembly and container neck in cross-section.
Figure 7:
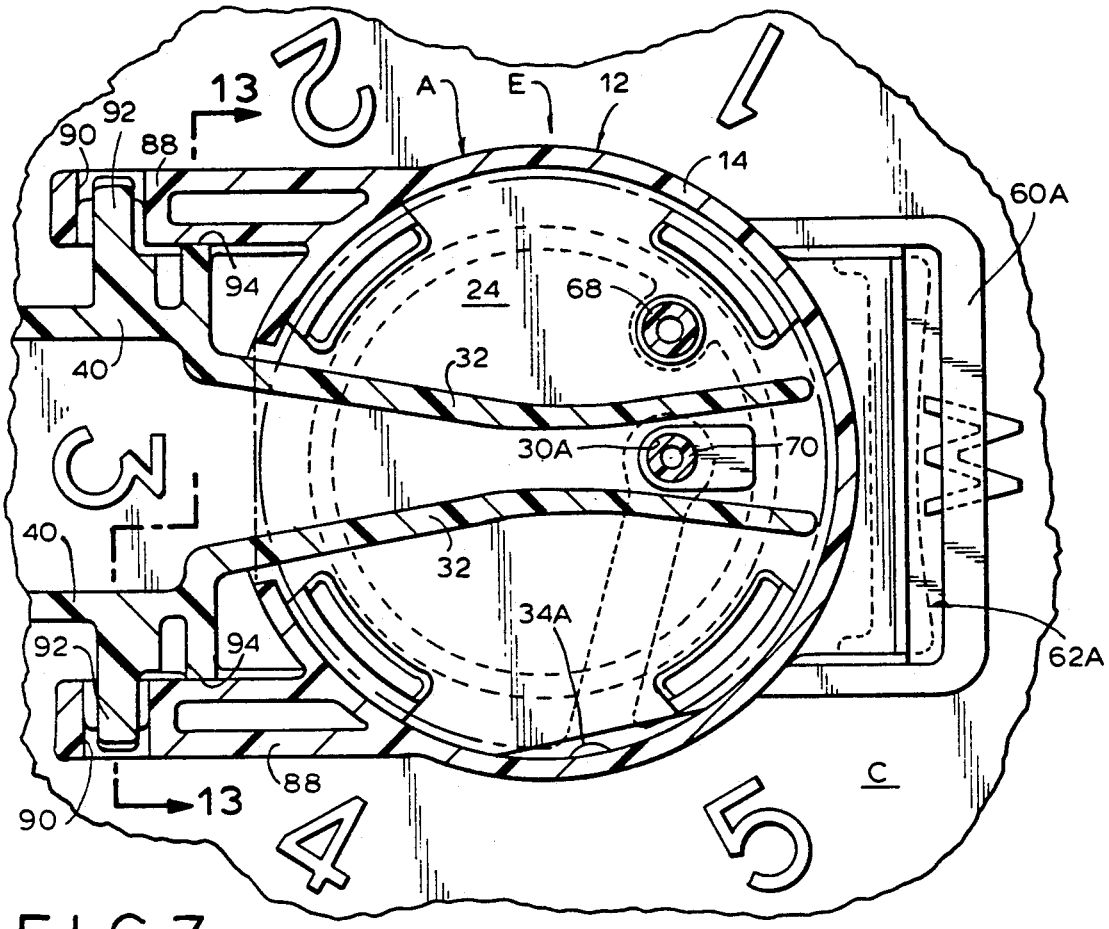
FIG. 7 is a cross-sectional view taken along the line 7—7 of FIG. 6.
Figure 9:
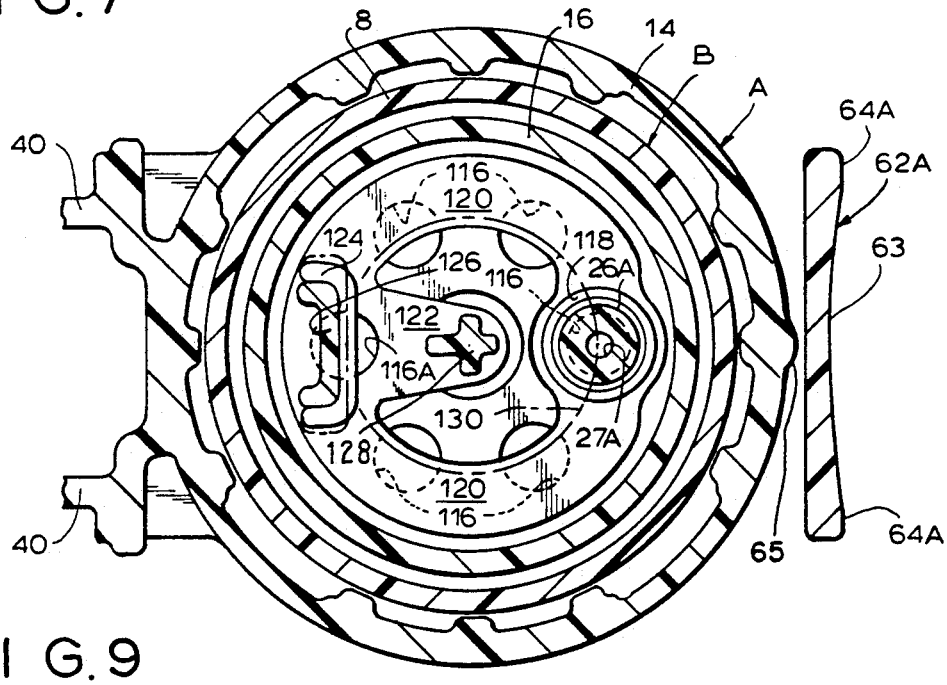
FIG. 9 is a cross-sectional view taken along the line 9—9 of FIG. 6.
Figure 10:
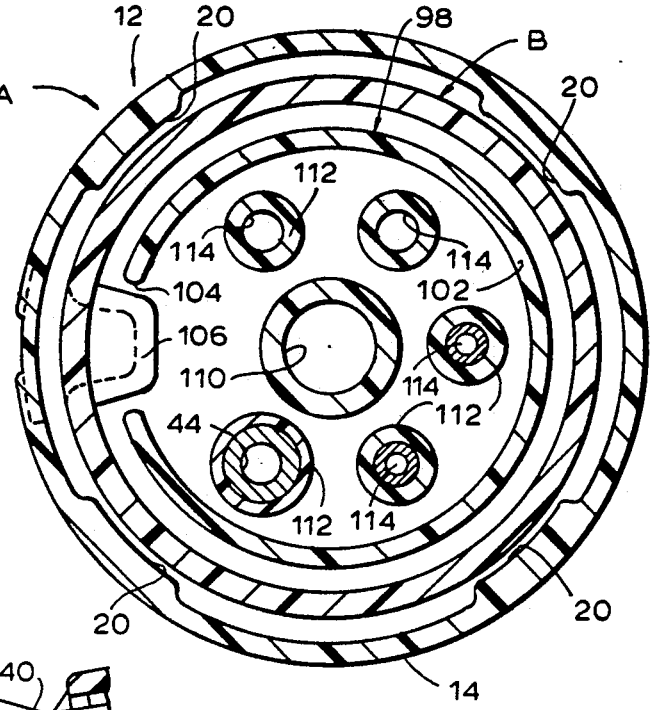
FIG. 10 is a cross-sectional view taken along the line 10—10 of FIG. 6.

While the sprayer as thus far described can function satisfactorily, it has the very significant drawback, from a safety point of view, that if the container-sprayer assembly is mishandled—e.g., falls down or is turned upside down—it constitutes a very serious hazard, since the contents of the container can escape through the aspiration passage 27, the air bleed passage 34 and/or the air vent passage 38. In order to eliminate this danger, and to do so in a positive and reliable but inexpensive manner, the assembly of the present invention is provided with a cap generally designated E. In the embodiment of FIGS. 1-5 that cap is designed to be located either in an operative position secured to the container C and performing its sealing function or to be separated and removed from the assembly. It comprises a top wall 52 and a depending side wall 54 terminating in a ring-like bottom portion 56 designed to sealingly engage a correspondingly shaped upper side 58 of the head 12. In order to releasably secure the cap E on the head 12, and to do so in a manner which will minimize the danger of accidental separation or separation by a child, the head 12 is provided with a pair of diametrically opposed ears 60 and the cap E is provided with a pair of similarly diametrically opposed tongues 62 provided at their lower ends with outwardly extending portions 64 which, because of the resiliency of the tongues 62, will snap beneath the ears 60 as shown in FIG. 5, those tongues having portions 66 extending below the ear-engaging portions 64.

The top wall 52 of the cap E is provided with a pair of appropriately positioned depending portions 68 and 70, the portion 68 sealingly entering and penetrating the depression 36 leading to the air vent 38 and the portion 70 sealingly entering and penetrating the upper portion of the passage 27 to a sufficient depth so as also to sealingly close off the air bleed passage 34. Hence when the cap E is in its operative position as shown in the drawings it will be reliably retained in that position by engagement between the ears 60 and the fingers 62 and all of the openings communicating between the interior and the exterior of the container will be engaged, closed and sealed. Hence no matter how the container may be handled, the dangerous contents of the container will remain within the container where they belong. When the sprayer is to be used the cap E can be readily removed by simultaneously pressing inwardly on the lower portion 66 of each of the fingers 62 and simultaneously urging the cap upwardly, a manipulation which, while not difficult for the normal sufficiently mature person, is not the type of manipulation that would ordinarily occur accidentally or that an immature child might accidentally perform. Hence a significant degree of child-proof safety is provided.

It will be seen from the above that the embodiment of FIGS. 1-5 performs all of the functions of the sprayer of our prior patent except for the ability to select different degrees of aspiration, and does so by means of a structure involving only five parts, including the bottle, dip tube and hose washer, with the latter two being relatively stock items and with the other three being readily and inexpensively moldable from appropriate chemical-resistant plastic material. The reduction in the number of parts not only makes for inexpensiveness, significantly including ease of assembly, but also adds to sturdiness and reliability over an extended period of time.

The embodiment of FIGS. 6-17 is somewhat more complex than the embodiment of FIGS. 1-5 but it embodies additional features, to wit, a flow control valve generally designated F for the aspirating fluid, a pivotal mounting for the cap E so that when it is in its aspiration-permitting position it remains attached to the assembly but retained in that position (either or both of these features could be incorporated into the embodiment of FIGS. 1-5 if desired), and it also provides for selection of different degrees of aspiration by means of a structure simpler than that employed in the sprayer of our prior patent. In the embodiment of FIGS. 6-17 parts common to it and to the embodiment of FIGS. 1-5 have the same reference numerals applied thereto as in the prior embodiment, and will not be separately mentioned. Similar but structurally different parts may carry the same reference numeral distinguished, however, by the letter A.

Figure 12:
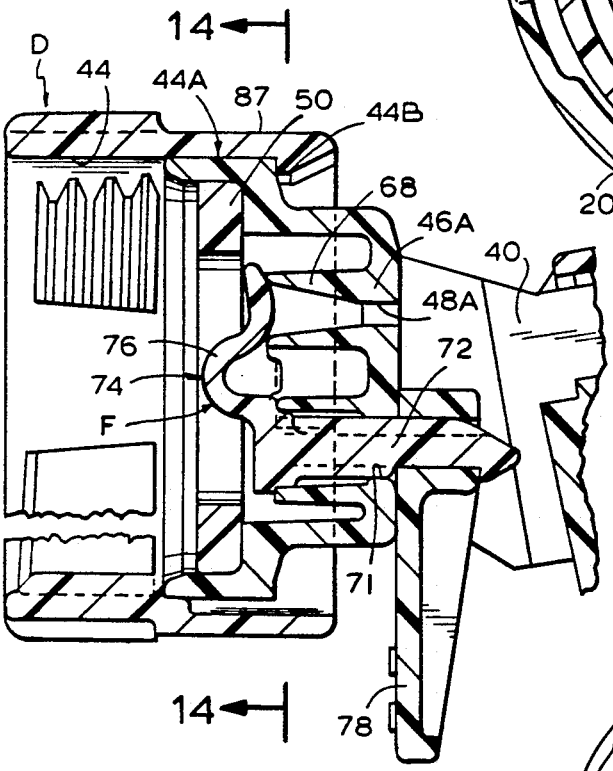
FIG. 12 is a cross-sectional view taken along the line 12—12 of FIG. 11.
Figure 11:
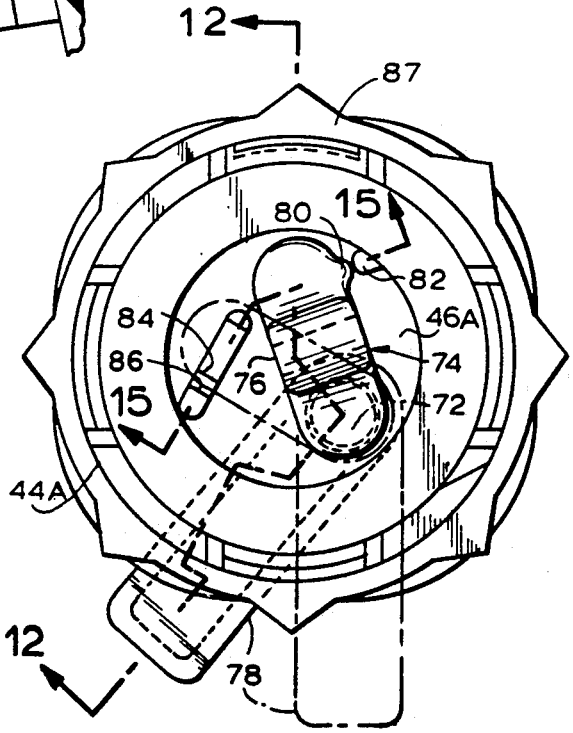
FIG. 11 is an end elevational view of the hose-end-receiving portion of the assembly of FIG. 6.

In the embodiment of FIGS. 1-5 control of the flow of the aspirating fluid can be accomplished by placing one's finger over the exposed end of the nozzle 48. Many persons may find this undesirable. By the addition of only two parts manual control of the flow of the aspirating liquid is accomplished in a reliable and foolproof manner. The wall 46A carried between the arms 40 has rearwardly extending therefrom a cylindrical wall 68 communicating with a nozzle opening 48A. That wall 46A is further provided with an opening 71 through which the shaft portion 72 of a control member generally designated 74 is sealingly rotatively received, that shaft portion 72 being integral with a resilient arm 76 located inside the coupling nut D and so shaped as to be receivable over the open mouth of the cylinder 68, as shown in FIG. 12, thereby to seal that opening and prevent the flow of water therethrough. The shaft portion 72 extends beyond the wall 46A into the space between the arms 40 and is there provided with an operating lever 78 fast on the shaft portion 72, so that rotation of the lever 78 moves the arm 76 from its position closing access to the nozzle 48A to a position exposing the mouth of the cylinder 68 so that water can flow through the nozzle opening 48A. Because of the resiliency of the arm 76 sealing engagement between that arm and the cylinder 68 will be accomplished with a detent action, thus making it apparent to the user that the valve is in its closed position. The arm 76 may be provided with a lateral protrusion 80 (see FIG. 11) engageable with an inward protrusion 82 on the fixed structure in order to provide a positive stop to the arm 76 when it is moved to its valve-closing position. A recess 84 is provided in the wall facing the arm 76 into which that arm 76 may snap when it is moved to its valve-opening position, thus providing detent engagement of the valve in that open position and giving to the operator of the valve a physical signal that it is in that position. Further, a protrusion 86 on the fixed structure is provided as a positive stop to the arm 76 when it is moved to its valve-open condition. (In the embodiment here under discussion the internally threaded wall 44 forms a part of a separate nut 87 which is rotatably mounted on the fixed structure 44A carried by the arms 40, thus making the nut 87 rotatable on the fixed structure and making it easier to attach the male end of a hose thereto. This is optional; it may also be used with the embodiment of FIGS. 1–5, or it can be eliminated and, for this portion of the structure, the one-piece arrangement of FIGS. 1–5 could be employed here.)

In this embodiment the cap E, which performs all of the functions of the cap E of the embodiment of FIGS. 1–5, remains permanently secured to the sprayer and pivots between its sealing and aspiration-permitting positions. To that end it is provided with rearwardly extending ears 88 (see FIG. 7) provided with openings 90 into which protrusions 92 from the arms 40 are received, thereby to provide a pivotal mounting for the cap E. The ears 88 are resilient so that they can be snapped over the protrusions 92, thereafter to resiliently press against the outer surfaces 94 of the fixed structure. At least one of those surfaces 94 is provided with an upwardly and inwardly inclined section 96 against which the corresponding ear 88 is pressed, so that when the cap E is lifted from its sealing position shown in solid lines in FIG. 6 toward its unsealing and aspiration-permitting position shown in broken lines the ear 88, urged inwardly by its own resilience, will move over the inclined surface 96, so that the cap E will be resiliently urged into and held in its lifted position. When it is desired to move the cap E to its closed or sealing position it is merely pushed down to that position against the limited force exerted by the resilient engagement of the ear 88 and the surface 96.

To retain the cap E in its sealing position in a child-proof fashion the body 12 is provided with a single ear 60A of appreciable width and the cover is provided with a single tongue 62A receivable thereinto for lid-retention purposes. The outer face 63 of that tongue 62A is concave, as may be seen from FIG. 9, and the outwardly extending ear-engaging portions 64A, with the corresponding depending portions 66A, are provided at the extreme sides of the tongue 62A but not throughout its width. The tongue 62A is designed to be pushed against an extending portion 65 on the wall 14 of the head 12 (see FIG. 6) for limiting the degree to which the tongue 62A can be pushed. Hence it is necessary to simultaneously press both of the downwardly extending portions 66A at the two sides of the tongue 62A, thereby to disengage the two outwardly extending portions 64A from the ear 60A to disengage the tongue 62A from the ear 60A, thus providing the needed child-proof safety feature.

In order to provide means for selecting aspiration of different magnitudes, the sprayer assembly is provided with a separate aspiration tube carrier generally designated 98 comprising a horizontal wall 100 and a depending cylindrical wall 102, the wall 102 being provided with a notch 104 into which an inward protrusion 106 of the bottle structure is adapted to be received, thereby to fix the rotative position of the tube carrier 98 with respect to the container C when the former is in position, resting on the protrusion 108 extending inwardly from the lower portion of the bottle neck 8. The wall 100 is provided with a central opening 110 and with a plurality (here shown as five in number) of downwardly extending tubes 112 to which dip tubes 33 may be attached, each of the tubes 112 terminating at the wall 100 in an aperture 114 located within a depression 116, the apertures 114 for the different tubes 112 being of different sizes so as to differently control the degree of aspiration.

The wall 24 of the body 12 is provided with a downwardly depending portion 26A similar to the downwardly depending portion 26 of the embodiment of FIGS. 1–5 except that it is not centrally located and the passage 27A that it defines is of relatively large diameter so as not to restrict the degree of aspiration. Sealingly mounted on that downwardly depending portion 26A and axially movable relative thereto is an adapter 118 the lower portion of which is apertured and tapered so as to fit into the depressions 116 in the wall 100. That adapter 118 is (see FIGS. 16 and 17) carried at and integral with the ends of arcuate arms 120 joined at their other ends, connected to tongue 122, and provided with an upwardly extending U-shaped wall 124. The arms 120 and tongue 122 define a resilient structure. The top wall 24 of the body 12 is provided with two depending fingers 126 and 128. The finger 126 is received inside the U-shaped space defined by the wall 124. The finger 128, somewhat longer than the finger 126, engages the tongue 122 and presses it downwardly. As a result of this engagement the ring 120 carrying the adapter 118 will rotate with the head 12 by virtue of the engagement between the finger 126 and the wall 124, and the adapter 118 will be resiliently urged downwardly into engagement with the wall 100 by virtue of the resiliency of the arms 120 and tongue 122 and the pressure exerted on the tongue 122 by the finger 128. The adapter 118 engages the downwardly depending portion 26A with a sliding seal. Hence as the head 12 is rotated relative to the bottle C the adapter 118 will be moved from one depression 116 to another. One of the depressions 116' (see FIG. 6) has an imperforate bottom wall. When the adapter 118 is in that depression 116' there will be no aspiration when water is sprayed. When the head 12 is rotated to bring the adapter 118 into a selected other one of the depressions 116 aspiration will occur, to a degree determined by the size of the opening 114 leading into that particular depression 116.

While the resiliency of the adapter carrier 120, 122 is sufficient to provide for a proper sealing engagement between the adapter 118 and the depression 116 into which it is received, it may be desired to provide a compression spring 130 active between the wall 24 and the adapter 118, which spring 130 may be used either with or instead of the carrier 120, 122.

The embodiment of FIGS. 6–17 is more complex than the embodiment of FIGS. 1–5, involving the use of ten separate parts (excluding the optional spring 130) but this is still eight fewer parts than the embodiment of our previous patent.

If the container-sprayer combination of FIGS. 6–17 is turned on its side or upside down the container contents may flow out through the opening 110 and possibly also through the dip tubes 33 and opening 114, but that liquid will be contained within the walls 16 and 24 because of the seal 18 between the wall 16 and the bottle neck 8, thus preventing any of the dangerous liquid from escaping, and when the container is once again placed right side up that liquid will flow back down into the container through the opening 110.

The embodiment of FIGS. 18–21 is essentially similar to that of FIGS. 6–17 except for the structure employed to produce the selection of the degree of aspiration. In this third embodiment the wall 100A of the tube carrier 98A is not provided with the depressions 116, but instead is smooth over the area that the adapter 118A slides as the head 12 is rotated relative to the container C. That adapter 118A is provided with a resilient cup-like portion 118B communicating with an upstanding tube 118C and sealingly slidably received within tube 26B extending downwardly from the wall 24. Slidingly received over the downwardly extending tube 26B is a cylinder 130 the lower portion 132 of which engages and presses downwardly on the cup 118B. The cylinder 130 is carried by a pair of spaced resilient arms 120A connected at their ends by an upstanding tubular element 124A. The wall 24 is provided with a depending finger 126A which is received within the cylinder 124A, and is further provided with a pair of depending fingers 128A each of which engages and presses downwardly on a different arm 120A, thus, via the cylinder 130 carried at the ends of the arms 120A, pressing the cup-shaped adapter 118A down into engagement with the upper surface of the wall 100A. This represents a different, and probably sturdier, means of enabling a selection of different degrees of aspiration by rotating the sprayer relative to the container.

Any suitable means may be provided for indexing the body 12 into its operative rotative positions. As disclosed in FIGS. 19, 20 and 21, that indexing is provided by downward protrusions 140, mounted on the element of which the resilient arms 120A are a part, which are receivable in appropriately positioned depressions 142 on the upper surface of the tube carrier 98A.

Since in these last two embodiments there is a position on the tube carrier 98 or 98A where the adapter 118 or 118A does not communicate with the interior of the container, thus preventing aspiration from taking place even though the aspirating fluid is being sprayed over the aspiration opening, there is no need in these embodiments for the air bleed passage 34 of the embodiment of FIGS. 1–5. However, such an air bleed opening 34A can be provided if desired in order to permit the user to shift between aspiration and no aspiration without having to rotate the sprayer body 12 with respect to the container.

With the embodiments here disclosed, spray heads permanently attached to the bottle containing the chemical to be sprayed permit control of spraying and aspiration, including in some embodiments control of the degree of aspiration, while effectively sealing the container-sprayer combination against accidental escape of the container contents with a high degree of safety, particularly against accidental opening by children, and this is accomplished by simple, inexpensive and sturdy construction involving a minimal number of parts that may be readily molded from suitable plastic material, easily assembled, and readily manipulated.

While only a limited number of embodiments of the present invention have been here disclosed, it will be apparent that many variations may be made therein, all within the scope of the instant invention as defined in the following claims.

We claim:

1. A chemical sprayer comprising a container for the chemical to be sprayed, an aspiration assembly comprising a structure having an aspiration means adapted to communicate with the interior of said container and means for guiding a flow of fluid past said aspiration means and out from said structure, means for mounting said assembly on said container, a cover receivable on said structure in an operative position, and releasable means for retaining said cover in said operative position, said cover having a part extending therefrom which, when said cover is in said operative position, engages and substantially completely seals said aspiration means so as to prevent the chemical from escaping from the container, in which said aspiration means comprises an aspiration passage having an end open toward said cover when said cover is in said operative position, said cover part then entering and blocking said aspiration passage, and in which said aspiration assembly has an air bleed passage communicating with said aspiration passage below its open end, said cover part, when said cover is in said operative position, reaching and blocking said air bleed passage.

2. The chemical sprayer of claim 1, in which said structure is rotatably mounted on said container and in which said assembly further comprises a wall fixedly mounted on said container and comprising a plurality of open-topped apertures communicating with the interior of said container, said aspiration means on said rotatable structure comprising a tube depending toward said wall, an adapter sealingly slidable on said tube, engageable with said wall, and adapted to engage over a selected one of said open-topped apertures and define a fluid communication path between said tube and said selected aperture, and resilient means urging said adapter toward said wall.

3. The chemical sprayer of claim 2, in which said rotatable structure sealingly engages said container, thereby to prevent escape of any of the container contents in the space above said fixedly mounted wall.

4. The chemical sprayer of claim 2, in which said resilient means comprises a resilient arm carrying said adapter, engaged with said structure for rotation therewith, and biased by engagement with a part of said structure so as to resiliently urge said adapter toward said wall.

5. The chemical sprayer of claim 4, in which said adapter and said arm are together of one-piece construction.

6. The chemical sprayer of claim 4, in which said arm carries a downwardly and upwardly opening housing which upwardly receives said depending tube and which downwardly receives said adapter, said adapter having a part sealingly engaging said depending tube.

7. The chemical sprayer of claim 2, in which said resilient means comprises a spring substantially coaxial with said tube and active between said adapter and said rotatable structure.

8. The chemical sprayer of claim 4, in which said aspiration means is carried by a second wall upwardly spaced from said fixedly mounted wall and in which said part of said structure engaging said resilient arm comprises an element extending downwardly from said second wall.

9. The chemical sprayer of claim 4, in which said aspiration means is carried by a second wall upwardly spaced from said fixedly mounted wall and in which said part of said structure engaging said resilient arm comprises an element extending downwardly from said second wall and located between said adapter and the point where said arm is engaged with said structure for rotation therewith.

10. The chemical sprayer of claim 1, in which said structure has an air vent passage therethrough communicating with the interior of said container, said cone having a part which, when said cone is in said operative position, engages and seals said air vent passage.

11. A chemical sprayer comprising a container for the chemical to be sprayed, an aspiration assembly comprising a structure having an aspiration means adapted to communicate with the interior of said container and means for guiding a flow of fluid past said aspiration means and out from said structure, means for mounting said assembly on said container, a cover receivable on said structure in an operative position, and releasable means for retaining said cover in said operative position, said cover having a part extending therefrom which, when said cover is in said operative position, engages and substantially completely seals said aspiration means so as to prevent the chemical from escaping from the container, and in which said structure has an air vent passage therethrough communicating with the interior of said container, said cover having a part which, when said cover is in said operative position, engages and seals said air vent passage.

12. A chemical sprayer comprising a container for the chemical to be sprayed, an aspiration assembly comprising a structure having an aspiration means adapted to communicate with the interior of said container and means for guiding a flow of fluid past said aspiration means and out from said structure, means for rotatably mounting said assembly on said container, said assembly comprising a wall fixedly mounted on said container and comprising a plurality of open-topped apertures communicating with the interior of said container, said aspiration means on said rotatable structure comprising a tube depending toward said wall, an adapter sealing slidable on said tube, engageable with said wall, and adapted to engage over a selected one of said open-topped apertures and define a fluid communication path between said tube and said selected aperture, and resilient means urging said adapter toward said wall.

13. The chemical sprayer of claim 12, in which said rotatable structure sealingly engages said container, thereby to prevent escape of any of the container contents in the space above said fixedly mounted wall.

14. The chemical sprayer of claim 12, in which said resilient means comprises a resilient arm carrying said adapter, engaged with said structure for rotation therewith, and biased by engagement with a part of said structure so as to resiliently urge said adapter toward said wall.

15. The chemical sprayer of claim 14, in which said adapter and said arm are together of one-piece construction.

16. The chemical sprayer of claim 14, in which said arm carries a downwardly and upwardly opening housing which upwardly receives said depending tube and which downwardly receives said adapter, said adapter having a part sealingly engaging said depending tube.

17. The chemical sprayer of claim 14, in which said resilient means comprises a spring substantially coaxial with said tube and active between said adapter and said rotatable structure.

18. The chemical sprayer of claim 12, in which said aspiration means is carried by a second wall upwardly spaced from said fixedly mounted wall and in which said part of said structure engaging said resilient arm comprises an element extending downwardly from said second wall.

19. The chemical sprayer of claim 12, in which said aspiration means is carried by a second wall upwardly spaced from said fixedly mounted wall and in which said part of said structure engaging said resilient arm comprises an element extending downwardly from said second wall and located between said adapter and the point where said arm is engaged with said structure for rotation therewith.

20. A chemical sprayer comprising a container for the chemical to be sprayed, an aspiration assembly comprising a structure having an aspiration means adapted to communicate with the interior of said container and means for guiding a flow of fluid past said aspiration means and out from said structure, means for mounting said assembly on said container, a cover receivable on said structure in an operative position, and releasable means for retaining said cover in said operative position, said cover having a part extending therefrom which, when said cover is in said operative position, engages and substantially completely seals said aspiration means so as to prevent the chemical from escaping from the container, in which said aspiration means comprises an aspiration passage having an end open toward said cover when said cover is in said operative position, said cover part then entering and blocking said aspiration passage, and in which said structure has an air vent passage therethrough communicating with the interior of said container, said cover having a part which, when said cover is in said operative position, engages and seals said air vent passage.

* * * * *